United States Patent [19]

Gorran

[11] 4,065,819

[45] * Jan. 3, 1978

[54] FLOTATION SUPPORT SYSTEM

[75] Inventor: Jody A. Gorran, Highland Park, N.J.

[73] Assignee: Medpro, Inc., East Brunswick, N.J.

[ * ] Notice: The portion of the term of this patent subsequent to Oct. 5, 1993, has been disclaimed.

[21] Appl. No.: 696,590

[22] Filed: June 16, 1976

Related U.S. Application Data

[63] Continuation-in-part of Ser. No. 616,045, Sept. 23, 1975, Pat. No. 3,983,587.

[51] Int. Cl.[2] ..... A47C 27/08

[52] U.S. Cl. ..... 5/371; 5/92; 5/338

[58] Field of Search ..... 5/365, 337, 338, 370, 5/371, 91, 335, 92

[56] References Cited

U.S. PATENT DOCUMENTS

| | | | |
|---|---|---|---|
| 3,766,579 | 10/1973 | Shields | 5/368 |
| 3,787,908 | 1/1974 | Beck et al. | 5/91 |
| 3,838,470 | 10/1974 | May | 5/370 |
| 3,983,587 | 10/1976 | Gorran | 5/338 |

*Primary Examiner*—Robert L. Wolfe
*Assistant Examiner*—Kenneth J. Dorner
*Attorney, Agent, or Firm*—Stefan J. Klauber

[57] ABSTRACT

A flotation support system including a generally rectangular air frame, which is defined by a tubular air-filled member which surrounds an open region. A base sheet extends beneath the open region and is secured to the tubular member to define with such member a nesting receptacle for a fluid-containing envelope. The base sheet passes beneath the said frame and is secured to the tubular member toward the outer peripheral border thereof, to provide a receiving slot between the lower side of the tubular member and the adjacent portions of the sheet. The envelope has dimensions exceeding that of the open region, so that the peripheral portions of the envelope are received into the said slot. The peripheral portions of the envelope are elastically constrained by the slot, to thereby constitute a buffer volume for liquid displaced from the central portion of the envelope in consequence of an individual being emplaced upon such central portions, to thereby provide improved cushioning characteristics. The air frame also acts as a restraining bumper, which renders the assembly ideal for use in cribs or so forth.

11 Claims, 3 Drawing Figures

FLOTATION SUPPORT SYSTEM

BACKGROUND OF THE INVENTION

This application is a continuation-in-part of my copending application, Ser. No. 616,045, filed Sept. 23, 1975, now U.S. Pat. No. 3,983,587 and entitled WHEEL OR GERIATRICS CHAIR CUSHION.

This invention relates generally to cushioning structures, and more specifically, relates to a flotation support system.

Flotation support systems such as mattress assemblies including fluid-containing envelopes or other containers for supporting an individual, have achieved a wide degree of commercial success within recent years. Such devices are desirable not only by virtue of the comfort afforded the user thereof; but they further have been deemed valuable from a theraputic viewpoint — for use particularly with patients who, for one reason or another, are confined to bed for long periods, or who have only limited mobility. It is thus known that patients maintained under such conditions are subject to development of tissue breakdowns which result in decubitus ulcers — commonly known as bedsores. Cushioning devices based upon fluid support principles are valuable for these applications in that it is thereby possible to introduce a high degree of compliance to the surface upon which the individual rests, thereby uniformly spreading the reaction pressure over an extended area of tissue. The said fluid may comprise air; but preferably a liquid or gel is employed.

SUMMARY OF INVENTION

Now, in accordance with the present invention, a flotation support system is provided, including a generally rectangular air frame which is defined by a tubular air-filled member surrounding an open region. A base sheet extends beneath the open region and is secured to the tubular member to define with such member a nesting receptacle for a fluid-containing envelope. The base sheet passes beneath and is secured to the tubular member toward the outer peripheral border thereof, to provide a receiving slot between the lower side of the tubular member and the adjacent portions of the sheet. The envelope has dimensions exceeding that of the open regions, so that the peripheral portions of the envelope are receivable into the said slot. The peripheral portions of the envelope are elastically constrained by the slot to thereby constitute a buffer volume for liquid displaced from the central portion of the envelope in consequence of an individual being emplaced upon said central portion, to thereby provide improved cushioning characteristics. The air frame also acts as a restraining bumper, which renders the assembly ideal for use in cribs or in other applications wherein the individuals residing on the assembly would be in danger of falling from same.

By virtue of the construction set forth, it will further be evident that a water envelope of comparatively large dimensions is receivable into the aforementioned frame, i.e., the dimensions of the envelope may approximate those of the frame itself. Accordingly, one advantage of the present device is that the envelopes presently utilized atop bed structures, such as in hospital applications, may be directly used with the frame portion of the present assembly, thereby rendering the present device compatible with existing structures.

A further advantage of the present structure is that the separate nature of the fluid envelope — i.e. the envelope is completely separate from the enveloping frame — prevents gross spillage from the fluid envelope in the event a leak should occur therein.

A further advantage of the present invention is that the aforementioned restraining slot may serve to simultaneously restrain and position a mattress pad, which is placeable in overlying relationship to the fluid-filled envelope.

BRIEF DESCRIPTION OF DRAWINGS

The invention is diagrammatically illustrated by way of example, in the drawings appended hereto, in which.

DESCRIPTION OF PREFERRED EMBODIMENT

Figure 1:
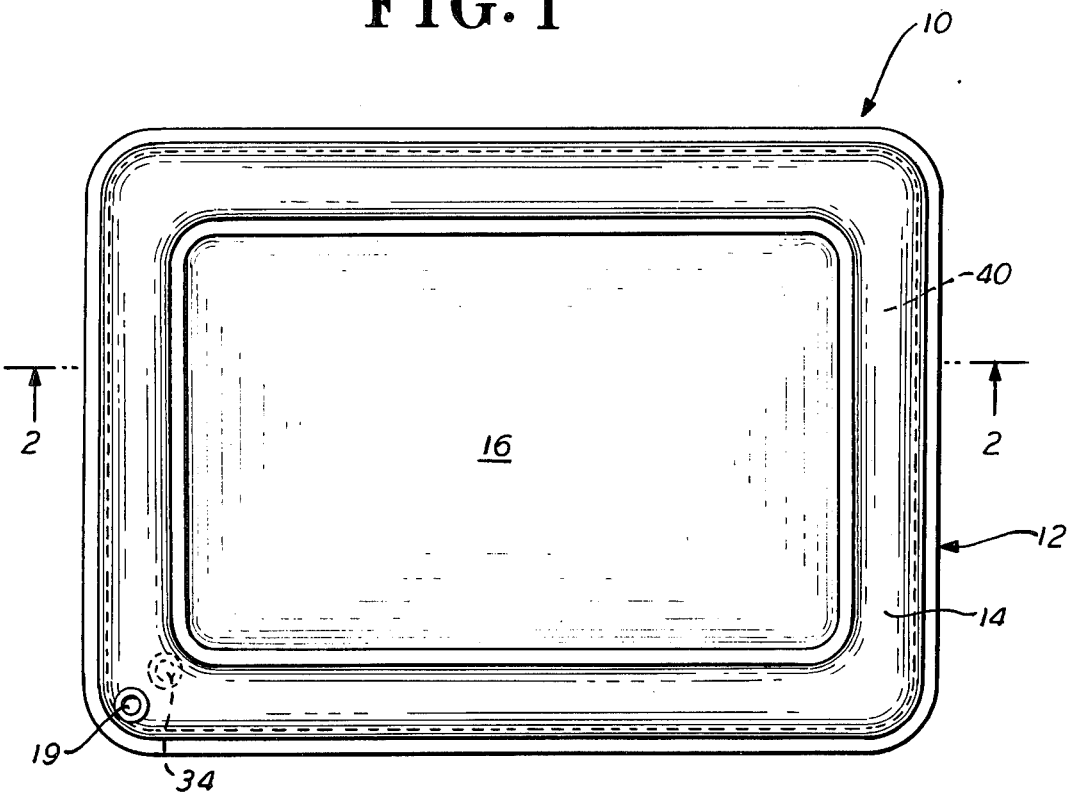
FIG. 1 is a top plan view of a flotation support system in accordance with the present invention.

In FIG. 1 herein, a top plan view appears of a flotation support system 10 in accordance with the present invention. The view of FIG. 1 may be considered simultaneously with the cross-sectional view of FIG. 2 in order to fully appreciate the structure of the present device.

System 10 is seen to consist of a generally rectangular air frame 12, which is defined by a tubular air-filled member 14, which surrounds an open region 16. Tubular member 14 may extend continuously as an open tube about the periphery of the structure, and may be formed from top and bottom pieces 15 and 13 of polyvinyl chloride, or similar tough thermoplastic, which are heat-sealed to one another along their inner and outer lateral edges 18 and 20. The said lateral edges 18 and 20, thus extend completely about the said frame at the inner and outer borders thereof.

The tubular member 14 is collapsible and is normally filled with air through a valve means 19, which is of conventional construction. A typical valve suitable for such purposes is, for example, available from Halkey-Roberts Company of Paramus, N.J., under the product designation "550-AC".

A fluid impervious base sheet 22, which again may comprise a heat-sealable thermoplastic such as the mentioned polyvinyl chloride, extends beneath the open region 16, and is secured to the tubular member about the entire periphery thereof to define with such member a nesting receptacle for a fluid-containing envelope 24. In accordance with one aspect of the present invention, the base sheet 22 is preferably secured to tubular member 14 by sealing the sheet to a portion of tubular member 14 toward the outer peripheral border thereof. Thus, as best seen in the cross-sectional view of FIG. 2, the sheet 22 is preferably secured, as by heat-sealing, to the outer lateral edge 20 of the said tubular member. In consequence of this arrangement it will be clear that a receiving slot 26 is defined between the lower portion 13 of tubular member 14, and the portion 28 of the base sheet 22 which resides between the attachment area at edge 20 and the open region 16. The function of this receiving slot 26, which thus extends completely about and borders the open region 16, will become clear hereinbelow.

Fluid envelope 24, is per se a conventional device, which may comprise upper and lower layers 30 and 32 of a fluid impervious material such as the polyvinyl chloride plastic previously mentioned, which layers are sealed to one another along their lateral edges 33.

Like the tubular member 14, the fluid-filled envelope 24 is collapsible, and valve means 34, which again are of conventional construction, are utilized for providing a fluid to or from the interior of the said envelope. The fluid contained in envelope 24 preferably comprises a liquid such as water; but other liquids, including materials of greater or lesser viscosity than water may be utilized; and similarly, other flowable and semi-flowable materials, including gels, slurries, etc., may be used for filling the interior of envelope 24. The valve 34 previously mentioned, may comprise a conventional device, including an auxiliary flapper valve feature, such as the Roberts 10-10 AF valve, available from the aforementioned Halkey-Roberts Company.

Figure 2:
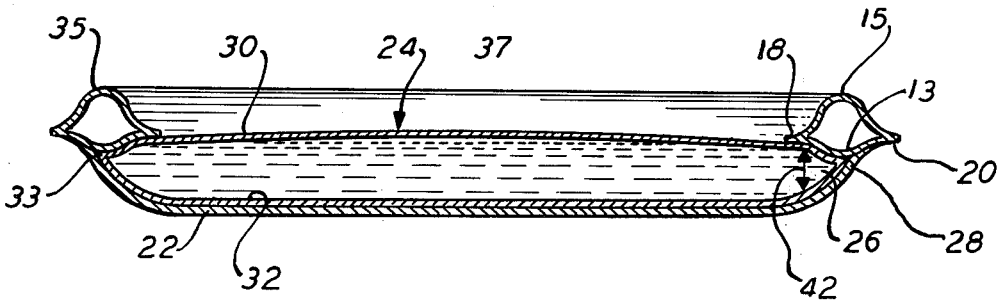
FIG. 2 is a cross-sectional view through the device of FIG. 1, taken along the line 2—2 of the said Figures.

By considering the cross-sectional view of FIG. 2 simultaneously with FIG. 1, the principal attributes of the present invention may now be appreciated. In particular, it will be seen that the receiving slot structure 26 previously mentioned, thus assures that the periphery 40 (FIG. 1) of envelope 24, resides well within the said slot, and in particular, well under the bulk of tubular member 14. Several important consequences flow from such arrangement. Among these is the fact that the fluid envelope 24 is firmly positioned and stabilized within the frame 12. A further significant consideration, is that the construction enables use of a fluid envelope 24 having relatively large dimensions. This is turn enables the fluid envelope 24 (which is in no way fixedly secured within the remainder of the appliance) to be removed and utilized (if desired) as a separate "mattress" in its own right. Were the dimensions of envelope 24 limited to those of the open region 16, it will be evident that the size of envelope 24 would be too limited to enable this separate use.

The fact that envelope 24 is indeed of dimensions comparable to those of frame 12, has another significant corollary. This is that present water envelopes, i.e., those already in use atop given bed frames, are dimensionally compatible with the present assembly. In particular, many water envelopes now in use are basically similar to envelope 24. Assuming that a user desires to employ assembly 10 on a given bed or crib, he need only choose the present tubular frame 12 as to have approximate dimensions compatible with his existing bed frame. The water envelope which may already be in use on the bed frame (even though its dimensions are approximately those of the bed frame) will now fit quite readily into tubular frame 12.

It may, incidentally, be observed that the very fact that fluid envelope 24 is separate from frame 12 and overlies fluid impervious sheet 22, assures that spillage of fluid will not occur from system 10, should a leak develop in envelope 24.

An equally significant advantage of the present arrangement derives from the fact that the portions of fluid envelope 24 held within receiving slot 26, are in effect elastically constrained therein. This is to say that while the top-to-bottom spacing 42 of such portion is constrained by slot 26, it is yet clear that spacing 42 is quite variable due to the elasticity of the slot boundaries. Accordingly, the lateral portions 40 of envelope 24 constitute a buffer volume, from which and to which, fluid may readily flow from other portions of the envelope.

Thus, in particular, it will be evident that when an individual is emplaced upon the present system, fluid may readily be displaced from the central portions of the fluid envelope 24 toward the buffer volume defined by the lateral portions 40 of the envelope which are within slot 26. Similarly it will be evident, that the elastic constraint present about these lateral portions, tend to cause fluid to flow back into central portions of the envelope when pressure is diminished by the individual shifting his weight, etc. The net effect of this arrangement, is to considerably improve the nature of the cushioning effect provided by the present device, vis-a-vis prior constructions.

Referring particularly to the cross-sectional view of FIG. 2, a further aspect of the present invention may now be appreciated. In particular, it will be seen that the uppermost portions 35 of tubular frame 14, reside well above the uppermost portion 37 of the fluid-containing envelope 24. The uppermost portions 35 of the said tubular frame, further are seen to be well above the adjacent portions of envelope 24, i.e., the lateral boundary portions 40 of envelope 24 which are, as already mentioned, contained within slot 26. The tubular member, therefore, serves in the nature of a protective bumper or resillient guard rail. This function of member 14 is particularly significant when the present system is utilized in a crib or in similar environment wherein the individual utilizing same is either an infant or is in an enfeebled condition necessitating some sort of restraining mechanism which acts to prevent an individual from toppling without the assembly.

Figure 3:
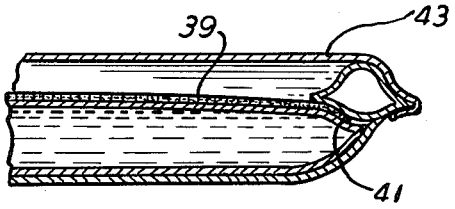
FIG. 3, is a fragmentary cross-sectional view, similar to FIG. 2, and depicting additional features that may be incorporated into the present assembly.

The slot 26, in addition to performing the functions heretofore discussed, provides a further additional function which is best illustrated in the fragmentary cross-sectional view of FIG. 3. This view is taken along the same direction as that of FIG. 2, except that two additional elements have been added to the device of FIG. 2. In particular, it will be seen that an insulation pad 39 has now been positioned atop the water envelope 24. Insulation pad 39 can be any conventional device of this nature, comprising cloth, foam rubber or so forth. The said pad is not fixedly secured to envelope 24, but rather is contiguous to same, i.e., simply placed atop said envelope. The lateral edges 41 of the said pad, however, are commonly retained within slot 26 along with the adjacent portions of the water envelope. Accordingly, the said slot serves to frictionally engage, and, to a limited degree, "clamp" the insulation pad in place to prevent its dislodgement — which could cause problems where infants or so forth, are placed atop the present device.

The said FIG. 3 also is seen to illustrate a resilient fluid impervious covering member 43 which may be secured about the entire top portion of the system 10. Cover 43, which may comprise a resilient or stretchable fluid impervious material, e.g. of PVC plastic, or rubber or so forth, is retained in place about the present structure by being stretched over the tubular frame 12, i.e. it is secured in such fashion by elastic bands or heat-sealed fitted corners being secured over the lateral edges 20 of the frame. The said cover 43 is very flexible and fluid impervious as indicated; hence an individual emplaced upon system 10 may be protected from becoming wet in the event of leakage of fluid from envelope 24.

While the present invention has been particularly set forth in terms of specific embodiments thereof, it will be understood in view of the present disclosure, that numerous variations upon the invention are now enabled to those skilled in the art, which variations yet reside within the teaching of the invention. Accordingly the invention is to be broadly construed, and limited only by the scope and spirit of the claims now appended hereto.

I claim:

1. A flotation support system, comprising in combination:

a generally rectangular air frame, defined by a tubular air-filled member surrounding an open region;

a base sheet extending beneath said open region and under said tubular frame, and being secured to said tubular member toward the outer peripheral edge of said frame, to thereby define with said member a nesting receptacle bounded by a receiving slot defined between the upper side of said sheet and the adjacent wall of said member;

a fluid-containing envelope being positioned in said nesting receptacle; said envelope having dimensions exceeding those of said open region, and the peripheral border portions of said envelope being received into said receiving slot.

2. A device in accordance with claim 1, wherein the said peripheral portions of said envelope are elastically constrained by said slot, said portions thereby providing a buffer volume for volumes of fluid displaced from the portions of said envelope within said open region in consequence of the positioning of an individual thereupon.

3. A device in accordance with claim 1, wherein the uppermost portions of said frame reside above the uppermost portions of said fluid-containing envelope, to thereby provide a restraining bumper for said individual.

4. A device in accordance with claim 2, wherein said sheet is secured to said frame by heat-sealing said sheet to a lateral edge extending along the lateral-most border of said tubular member.

5. A device in accordance with claim 4, wherein both said air frame and said envelope comprise a polyvinyl chloride.

6. An appliance in accordance with claim 2, wherein said envelope contains a liquid.

7. A device in accordance with claim 6, wherein both said frame and said envelope are collapsible, and include valve means for filling same with said air and fluid.

8. A device in accordance with claim 2, further including an insulation pad overlying said envelope, the periphery of said pad being maintained within said slot together with said peripheral portions of said envelope, to thereby restrain relative movement between said pad and envelope.

9. A device in accordance with claim 6, further including a fluid-impervious cover secured about at least the upper portions of said air frame, thereby covering said envelope to isolate an individual residing on said system from liquid leakage.

10. An air frame for use with a fluid-containing envelope in the formation of flotation support system; said frame comprising;

a tubular air-filled member surrounding an open region;

a base sheet extending beneath said open region and under said member, and being secured to said member toward the outer peripheral edge of said frame, to thereby define with said member a nesting receptable bounded by a receiving slot defined between the lower side of said sheet and the adjacent wall of said member;

whereby a fluid-containing envelope having dimensions exceeding those of said open region is positionable in said nesting receptacle, with the peripheral portions of said envelope being received into said receiving slot.

11. A frame in accordance with claim 10, wherein the boundaries of said slot are elastic, whereby the said peripheral portions of said envelope are elastically constrained by said slot, said portions thereby providing a buffer volume for fluid displaced from the portions of said envelope within said open region in consequence of the positioning of said individual thereupon.

* * * * *